United States Patent [19]

Smith

[11] 4,334,135

[45] Jun. 8, 1982

[54] UTENSIL LOCATION SENSOR FOR INDUCTION SURFACE UNITS

[75] Inventor: Peter H. Smith, Anchorage, Ky.

[73] Assignee: General Electric Company, Louisville, Ky.

[21] Appl. No.: 218,875

[22] Filed: Dec. 22, 1980

[51] Int. Cl.[3] ..... H05B 6/12

[52] U.S. Cl. ..... 219/10.49 R; 219/10.77; 219/518; 340/686; 324/260

[58] Field of Search ..... 219/10.77, 10.75, 10.49 R, 219/10.67, 10.43, 518, 450; 340/686, 687; 324/260, 261; 99/DIG. 14

[56] References Cited

U.S. PATENT DOCUMENTS

| | | | |
|---|---|---|---|
| 2,895,103 | 7/1959 | Vogt et al. | 324/260 |
| 3,796,850 | 3/1974 | Moreland et al. | 219/10.75 X |
| 3,823,297 | 7/1974 | Cunningham | 219/10.77 |
| 3,993,885 | 11/1976 | Kominami et al. | 219/10.49 R |
| 4,010,342 | 3/1977 | Austin | 219/10.77 X |
| 4,013,859 | 3/1977 | Peters, Jr. | 219/10.77 X |
| 4,016,392 | 4/1977 | Kobayashi et al. | 219/10.49 R |

FOREIGN PATENT DOCUMENTS

| | | | |
|---|---|---|---|
| 655999 | 4/1979 | U.S.S.R. | 324/260 |

*Primary Examiner*—B. A. Reynolds
*Assistant Examiner*—Philip H. Leung
*Attorney, Agent, or Firm*—H. Neil Houser; Radford M. Reams

[57] ABSTRACT

A utensil detection arrangement for an induction heating apparatus which provides a signal indicative of an off-center position of a cooking utensil supported on a cooking surface which overlies an induction heating coil. The detection arrangement comprises a conductive loop configuration located intermediate the heating coil and the cooking utensil in a plane parallel to the plane of the cooking surface and concentric with respect to the axis of the coil. The conductive loop is linked with the magnetic flux generated by the induction heating coil, which flux changes as a result of the position of a cooking utensil with respect to the axis of the coil and thereby generates a signal which changes in amplitude as a result of utensil position.

4 Claims, 6 Drawing Figures

PAN CENTERED
V1

PAN 0.5 IN. OFF CENTER
V2

PAN 1 IN. OFF CENTER
V3

UTENSIL LOCATION SENSOR FOR INDUCTION SURFACE UNITS

CROSS REFERENCES TO RELATED APPLICATIONS

This application is related generally in subject matter to pending application Ser. No. 108,087 in the name of H. Richard Bowles, entitled "Centered Utensil Sensor for Induction Surface Units" and pending application Ser. No. 108,086 in the name of Brent A. Beatty, entitled "Improved Sensing Arrangement for a Centered Utensil Detector," both being assigned to the same assignee as the instant application.

FIELD OF THE INVENTION

This invention pertains generally to induction heating and cooking apparatus, and in particular to a new and improved cooking utensil position detection arrangement incorporated into an induction heating and cooking apparatus for detecting the location of a pan or cooking utensil of magnetic metal relative to the geometric center of the cooking unit or the axis of the induction heating coil generating the electromagnetic field for the apparatus.

BACKGROUND OF THE INVENTION

Apparatus for inductively coupling an induction heating coil with a ferrous cooking utensil to thereby electromagnetically heat the contents of the utensil have been widely known and used for many years. In such apparatus, the indication coil is located below a magnetic flux-permeable cooking surface and an alternating current through the coil causes a continuously changing magnetic field to be generated. The magnetic flux of the magnetic field extends through the cooking surface to link with the cooking utensil to cause eddy currents in the utensil and allow it to heat up.

Prior art arrangements for induction heating and cooking appliances include sensing arrangements for determining whether a cooking utensil is in place on the cooking surface above the induction coil before the coil is energized. These sensing arrangements are designed to insure that the high intensity electromagnetic fields which emanate from the induction heating coil are generated only when a utensil is in position overlying the induction coil, thereby limiting the undesirable transmission or leakage of electromagnetic flux into the free space surrounding the cooking appliance.

Various types of sensor arrangements have been used for this purpose. For example, U.S. Pat. No. 3,796,850—Mooreland II et al discloses an arrangement which utilizes a reed switch coupled to two magnets. If a utensil is not present over the induction heating unit, the contacts of the reed switch are forced to close due to the magnetic flux produced by magnets located adjacent the unit. However, if a utensil is placed over the induction heating unit, the magnetic flux is not sufficiently strong to close the contacts of the reed switch and the induction unit is allowed to be powered.

Similarly, the detection arrangement of U.S. Pat. No. 3,993,885—Kominami et al includes a movable magnet, a fixed magnet and a reed switch situated between the two magnets. If a ferrous utensil is placed upon the induction heating unit, the movable magnet is attracted towards the pan and the flux lines near the reed switch are changed allowing power to be supplied to the heating coil.

U.S. Pat. No. 4,013,859—Peters, Jr., utilizes a very low power oscillator coupled to a load sensing coil to indicate the presence of a pan over the heating coil. Furthermore, U.S. Pat. Nos. 3,823,297—Cunningham; 4,016,392—Kobayashi et al; and 4,010,342—Austin include current or voltage detectors which also indicate the presence of a pan above the induction heating coil.

While the above noted patents disclose sensing arrangements which disable the inverter circuit of the induction heating coil in the absence of a utensil on the cooking surface, none of these patents is directed to the problem of disabling the induction heating coil if a utensil is present but nonetheless not centered with respect to the induction heating coil.

This latter situation creates an undesirable condition which results in the leakage of excessive magnetic flux into the space surrounding the cooking surface, which leakage may cause interference with television and radio signals and other communication systems. For this reason, among others, governmental regulating agencies have set limits on the magnetic field leakage of this type attendant to the use of induction heating appliances. Since the intensity of flux leaking into surrounding space increases as a result of operation of an induction heating unit with an improperly centered cooking utensil, it is desirable to provide an arrangement for insuring that operation of the unit takes place only when such utensils are properly positioned over the induction coil.

The aforementioned co-pending applications are directed to arrangements for detecting non-centered placement of a cooking utensil over an induction heating coil. Application Ser. No. 108,087 discloses a sensor arrangement for an induction heating apparatus which monitors the position of a ferrous cooking utensil on a cooking surface and disables an inverter circuit powering the induction heating coil if the utensil is located at an off-center position with respect to the coil, or if no utensil is present upon the cooking surface. The sensor arrangement disclosed in this application comprises a plurality of sets of sensors at successively larger distances from the center of the cooking surface. Each set comprises a plurality of sensors arranged on an imaginary circle substantially equidistant from each other. Each sensor operates to provide an indication of the presence or absence of a utensil directly above the sensor. The sensors are monitored by a logic arrangement which indicates whether a utensil is properly centered based on the fullness or degree of activation of the various sets. If the utensil is not properly positioned, the inverter is disabled and a signal advises the user of this condition. Additionally, the logic circuit determines the size of a properly positioned utensil and generates a signal which may be utilized to alter the output of the heating coil in accordance therewith.

Application Ser. No. 108,086 discloses a utensil detector for an induction heating apparatus which disables the inverter circuit if the utensil is located at an off-center position with respect to the heating coil, if no utensil is placed upon the cooking surface or if an incorrectly sized utensil is placed correctly on the cooking surface. The detector includes three sensor elements spaced 120° apart and situated beyond the periphery of the induction heating coil. The sensor elements monitor the intensity of the magnetic flux in areas adjacent the cooking zone directly affected by the position or size of the cooking utensil. If the combined outputs of the sensor elements do not meet a predetermined criteria, the inverter circuit connected to the induction heating coil is disabled, and the user is alerted to this condition.

OBJECTS AND SUMMARY OF THE INVENTION

It is therefore a primary object of the invention to provide an improved arrangement for limiting the intensity of the magnetic field leaked into the space surrounding an operating induction heating cooking apparatus.

A further object is the provision of a cooking utensil location sensing arrangement for providing a signal indicative of an off-center position of a cooking utensil with respect to the induction heating coil underlying the utensil.

A still further object is the provision of a cooking utensil position detector which is simple in design, and inexpensive in implementation.

These and other objects are accomplished according to the principle of the invention by provision of a utensil detection arrangement for an induction heating apparatus which provides a signal indicative of an off-center position of a cooking utensil supported on a cooking surface which overlies an induction heating coil. The detection arrangement comprises a conductive loop means located intermediate the heating coil and the cooking utensil in a plane approximately parallel to the plane of the cooking surface and symmetrical with respect to the center of the coil. The conductive loop in this position is linked with the magnetic flux generated by the induction coil, which flux changes as a function of the position of a cooking utensil with respect to the center of the coil and thereby generates a signal which changes in amplitude as a result of utensil position. The loop means includes an inner loop and an outer loop, each loop being concentric with each other and with the axis of the induction heating coil.

BRIEF DESCRIPTION OF THE DRAWINGS

Further details of the present invention and many additional advantages of this invention will be apparent from a detailed consideration of the remainder of this specification and the accompanying drawings in which.

DESCRIPTION OF THE PREFERRED EMBODIMENT

Figure 1:
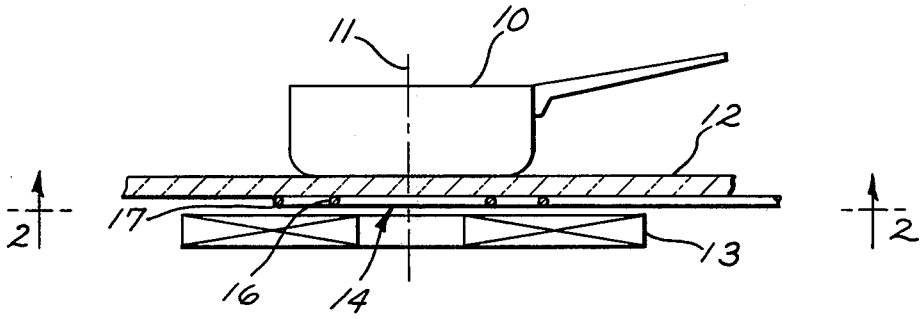
FIG. 1 is an illustrative vertical cross section showing the relationship in an induction heating-cooking unit between the cooking utensil, the cooking support surface, the induction heating coil and a sensing arrangement in accordance with the invention.

Referring to FIG. 1, the essential features of the present invention are schematically illustrated. A cooking container or pan 10 of a magnetic metal, such as iron or stainless steel, is located on a cooking support surface or plate 12 in overlying relation to an induction heating coil 13, the coil 13 being mounted underneath the cooking support surface 12 by any suitable means not shown herein. The support plate 12 may be formed of a substantially flat continuous sheet for supporting one or more utensils over one or more induction heating coils. The plate 12 is preferably constructed of a ceramic material such as glass which is waterproof, preferably electrically non-conductive and non-ferromagnetic in character.

The induction heating coil 13 preferably has a flat pancake-like shape and is mounted such that the central axis 11 of the coil, if extended upwardly through the cooking surface 12, passes through the geometric center 15 of the cooking area on which the pan 10 is to be located. The cooking unit also includes an inverter circuit (not shown) well known in the art, which is coupled to the coil 13 for producing an ultrasonic magnetic field linking the ferrous utensil 10. The utensil 10 acts as a single turn shorted secondary to be heated by the energy contained in the field. In a known manner, the field is produced by causing bidirectional current pulses in the coil 13.

A sensing device comprising an elongated conductor 14 having a relatively small cross sectional dimension and formed into a double loop configuration is located between the induction heating coil 13 and the utensil 10, preferably by attachment to the underside of the support surface 12 by any suitable means such as by an adhesive. The conductor 14 is shown in the drawings as a small diameter wire but it may alternatively comprise a conductive foil or thin film bonded to the underside of the support plate 12. It is alternately possible to locate the conductor 14 on top of the cooking surface 12 or embedded in the cooking surface, although these are less desirable from a practical or cost point of view.

The conductor 14 is located generally in a plane parallel to the plane of the support surface 12 and is configured into an inner loop 16 and an outer loop 17. The conductor 14 has its opposite ends terminated in suitable terminals 20 and 21 for ease of connection thereto. The cross sectional dimension of the conductor 14 may vary considerably while still providing a signal of sufficient magnitude for detection purposes. It is advantageous to use a conductor with as small a cross section dimension or thickness as possible since this minimizes the distance between the heating coil 13 and the utensil 10 and thereby maximizes the efficiency of the heating unit.

The outer loop 17 of the conductor 14 is preferably chosen to slightly exceed in diameter the maximum diameter or perimeter of the largest cooking utensil to be used or for which the induction cooking unit is designed. The inner loop 16 is preferably made to be slightly smaller in diameter than the diameter of the smallest cooking utensil to be used or for which the heating unit is designed. While the coils are shown as being in direct contact with the underside of the plate 12, they may alternatively be embedded or bonded into a separate magnetic field permeable sheet or block, which sheet is then attached to the underside of plate 12. Both the outer and inner conductive loops 16 and 17 are substantially concentric with each other and with the axis 11 of the induction coil 13.

Figure 2:
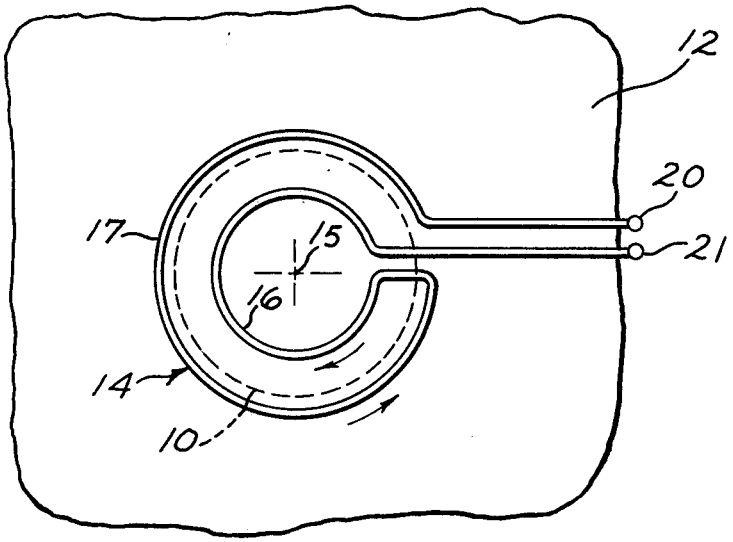
FIG. 2 is a plan view of the sensing loop along the lines 2—2 of FIG. 1.

Since the inner loop 16 and outer loop 17 are formed of the same conductor, current in loop 17 produced as a result of a changing magnetic field between the loops at any given instant adds to the current generated in loop 16. Specifically, if at a given instant current in outer loop 17 is in a counterclockwise direction as viewed in FIG. 2, current in loop 16 will be in a clockwise direction. This is illustrated by means of the arrows in FIG. 2. Thus, the oppositely directed conductive loops serve to amplify the effect of the magnetic field in much the same way that current in a coil serves to generate an intense magnetic field in a solenoid device. The sensivity of the sensor loop to changes in magnetic field produced by positional changes of the cooking utensil is thereby increased.

The conductive loop 14 operates to indicate the position of a cooking utensil with respect to the axis of the coil 13 by developing an output signal indicative of the magnetic flux linking its surface. Specifically, as the cooking utensil 10 is moved about the cooking area with respect to the geometric center 15, it presents different electrical loads to the magnetic field generated by the coil 13. Thus, when it is centrally located with respect to the axis of the coil 13 a maximum degree of coupling or loading is present and this results in a maximum intensity magnetic field linking the coil 13 and the utensil 10. Moreover, when the utensil is centered, the field is substantially symmetrical with respect to the axis of the coil 13. This is intuitively obvious since when the utensil is off-center a greater area of high permeability material is presented to one radial section of the field than to the remainder which imbalances the intensity of the field with respect to the center axis of the coil.

These changes in the intensity and uniformity of the magnetic field attendent to positional changes of the utensil with respect to the center of the cooking area are sensed by the coil and translated into a signal which varies in amplitude.

Figures 4A, 4B, 4C:
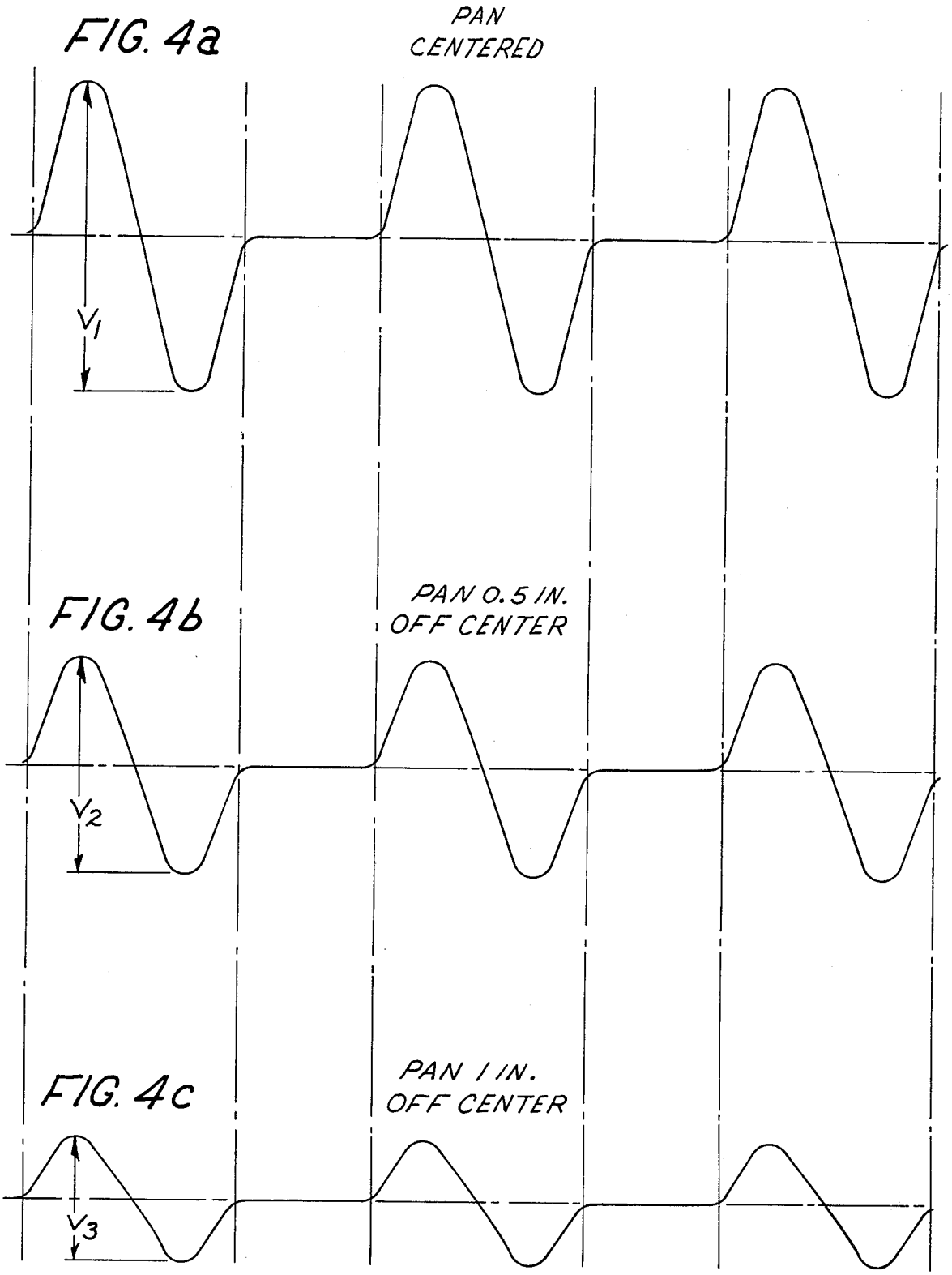
FIGS. 4A, 4B and 4C are graphs illustrating the voltage output of the sensing loop as a function of different off-center positions of a cooking utensil in a typical induction heating unit.

FIGS. 4A and 4C show representative voltage signals developed by the conductive sensor loop 14 as a function of the position of the cooking utensil during energization of the coil 13. The signal in FIG. 4A represents the voltage produced in the sensing loop by a centered utensil. Note that the peak-to-peak voltage is represented by a magnitude $V_1$. FIG. 4B shows the voltage signal developed when the utensil is moved approximately 0.5 inches off-center. It is noted that the peak-to-peak voltage in FIG. 4B has decreased to the value $V_2$. Similarly, FIG. 4C illustrates the voltage developed in the conductive sensor loop when the cooking utensil is positioned one inch off the central axis of the coil 13. Notice again that the peak-to-peak voltage has decreased still further to a value $V_3$ which is less than $V_2$.

The voltage outputs $V_1$, $V_2$, $V_3$ vary in large measure as a function of the parameters of the various components making up the induction unit and the size and spacing of the conductive loops 16 and 17. The voltages, however, decrease in any configuration as a function of the off-center position of the utensil as generally illustrated in FIG. 4.

Figure 3:
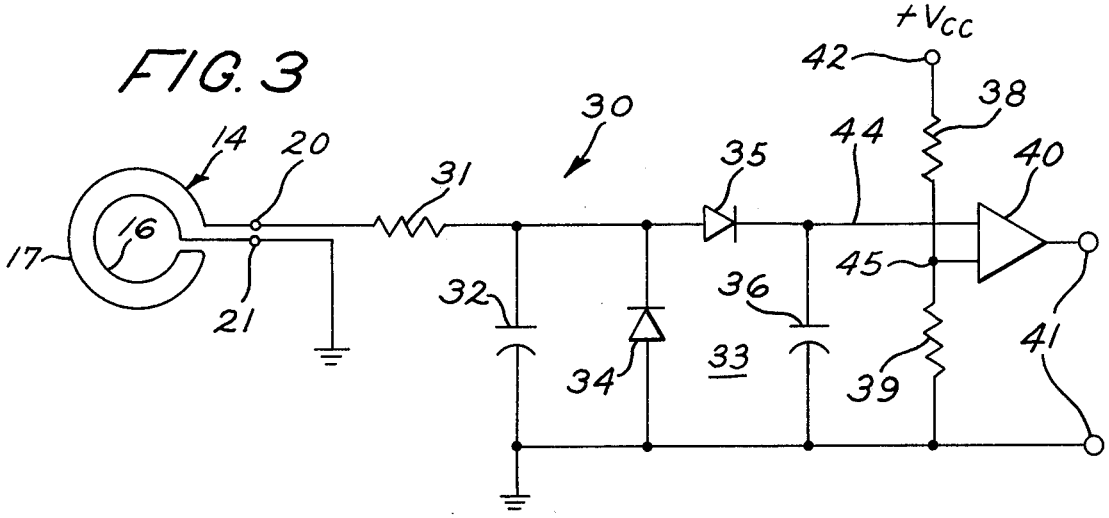
FIG. 3 shows a simplified schematic circuit usable in conjunction with the disclosed sensing arrangement to detect the utensil position signal generated by the sensing loop means of the invention.

A simplified schematic of a circuit 30 suitable for coupling to the conductor 14 for detecting the magnitude of the voltage signal generated in the loop during operation of the induction unit is shown in FIG. 3. One side of the loop 14 (terminal 21) is conducted to a common ground and the other side (terminal 20) is transformed by a signal conditioner into a signal suitable as one input to a comparator 40 on line 44. The signal conditioner includes a resistor 31 and capacitor 32 coupled in series with each other between terminal 20 and the common ground. A rectifier filter arrangement 33 including diodes 34 and 35 and capacitor 36 transforms the varying signal across the capacitor 32 into a DC voltage on line 44. One input of the comparator 40 is coupled to line 44. A voltage divider including resistors 38 and 39 is coupled between a potential $V_{cc}$ at terminal 42 and ground to provide a reference potential at the junction 45 between resistors 38 and 39, which junction is coupled to the other input of the comparator 40.

The transformed voltage output of the sensor loop 14 on line 44 serves as the positive input to the comparator 40. The reference voltage at junction 45 is chosen so that it is less than the voltage on line 44 when the cooking utensil 10 is centered upon the cooking surface 12 with respect to the coil 13, but is more than the voltage produced on line 44 when the utensil is improperly positioned with respect to the coil 13. The exact voltage levels are dependent, of course, upon the spacing and ratings of the components of the cooking unit and upon the exact configuration and size of the loops 16 and 17.

Thus, with the utensil properly centered, the comparator 40 generates a first polarity signal at terminals 41 indicative of the fact that the voltage on line 44 is higher than that at junction 45. This first polarity output is used to permit the coil 13 to be energized. However, if the utensil is located in an off-center position with respect to the coil 13, the signal on line 44 drops below that at the junction 45 and a second polarity output is provided at output terminals 41 by the comparator 40. This latter output is utilized to inhibit the energization of the induction coil 13 or, alternatively, to activate an alarm circuit to alert the appliance user to adjust the position of the pan. By selecting the proper reference potential at junction 45 with respect to the voltage produced by a centered utensil on line 44, the off-center distance needed to trigger a change in the state of the comparator 40 may be preselected.

It will be apparent therefore that the present invention provides a means for monitoring the position of a ferromagnetic utensil on a cooking support surface overlying an induction heating coil and providing a control signal which may be used to energize and deenergize the heating coil or alternatively warn an appliance user of the off-center condition.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. An induction cooking apparatus comprising:

a cooking surface for supporting a ferrous cooking utensil, said cooking surface having a geometric center;

an induction heating coil positioned below said surface for producing an ultrasonic magnetic field linking the ferrous utensil for heating the contents of the utensil, said heating coil having a geometric center aligned with the geometric center of said cooking surface;

conductive loop means located in a plane substantially parallel to said cooking surface intermediate said cooking surface and said induction coil for providing a signal responsive to the magnetic field between said induction heating coil and the ferrous cooking utensil; said loop means being formed as a single continuous conductor including an inner loop of a smaller diameter than the smallest utensil to be used with said apparatus and an outer loop of a larger diameter than the largest utensil to be used with said apparatus, said loops being concentrically positioned with their geometric centers substantially aligned with the geometric center of said cooking surface so that the signal provided by said loop means varies from a maximum in accord with any off center positioning of the cooking utensil on said cooking surface.

2. The combination recited in claim 1 wherein said loop means is attached to the side of said cooking surface facing said coil.

3. The combination recited in claim 1 further including means for monitoring said control signal to indicate when said utensil is positioned a preselected distance from said geometric center.

4. The combination recited in claim 1 wherein said loop means comprises a wire attached to the side of said surface facing said coil.

* * * * *